United States Patent [19]

Lauener

[11] 4,022,041

[45] May 10, 1977

[54] METHOD OF ROLLING INGOTS INTO METAL STRIPS

[75] Inventor: Wilhelm Friedrich Lauener, Langenhard, Switzerland

[73] Assignee: Rollcast S.A., Zug, Switzerland

[22] Filed: May 19, 1976

[21] Appl. No.: 687,934

[30] Foreign Application Priority Data

May 21, 1975 Switzerland ..... 6529/75

[52] U.S. Cl. ..... 72/15; 72/252

[51] Int. Cl.[2] ..... B21B 37/00; B21B 39/00

[58] Field of Search ..... 72/14, 15, 10–12, 72/191, 250, 252

[56] References Cited

UNITED STATES PATENTS

| | | | |
|---|---|---|---|
| 3,136,183 | 6/1964 | Dart | 72/12 |
| 3,651,676 | 3/1972 | Robertson | 72/12 |

*Primary Examiner*—Milton S. Mehr

*Attorney, Agent, or Firm*—Burns, Doane, Swecker & Mathis

[57] ABSTRACT

A major deformation machine having two working roller systems with parallel axes, for example a planetary mill, is used for rolling ingots into metal strip. An ingot is forced into this major deformation machine by means of a conveyor mechanism. As the trailing end of the ingot nears the major deformation machine the conveyor mechanism is stopped and the spacing between the axes of the working roller systems is reduced by means of an adjusting mechanism, in order to roll the part of the work in the roller contact section of the machine until separation takes place. The so-separated rear end section of the ingot is then drawn back out of the machine. These operations can be controlled automatically by a control device including a detector operable by the end of the ingot approaching the major deformation machine.

7 Claims, 2 Drawing Figures

METHOD OF ROLLING INGOTS INTO METAL STRIPS

Figures 1, 2:
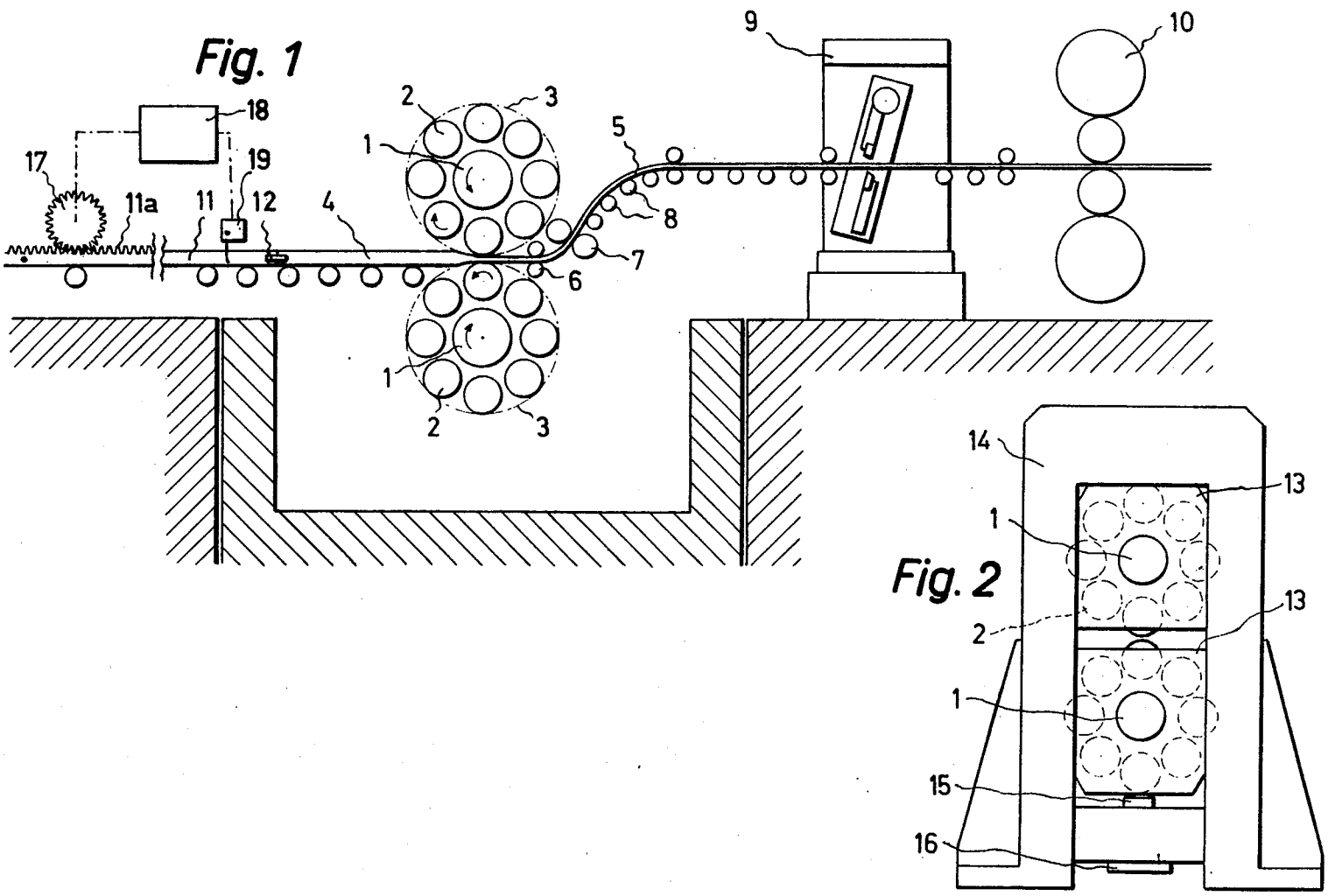

The rolling of ingots, that is to say cast or pre-rolled blocks with a thickness of about 300 mm and a length of for example up to about 15 m, into hot strip of a thickness of about 35 or 40 or 45 mm, which can then be worked into metal sheet, has usually hitherto been carried out by means of reversible two-high or four-high mills. In view of the severe reduction in thickness a number of rolling passes are necessary and complicated apparatus demanding a considerable amout of space is required.

So-called major deformation machines have also been introduced for the same purpose, these being capable of producing a considerable reduction in thickness in one operating stage. Such major deformation machines are for example planetary, pendulum and rocker mills in which in each of two roller systems arranged at opposite sides of the work at least one working roller is not only rotated but at the same time turns about an axis eccentric to that of the roller or is rocked with a reciprocating motion, as for example a planetary mill of the kind described in U.S. Pat. No. 3,769,826, Lauener, issued Nov. 6, 1973.

Because of the intrinsic characteristics of the aforesaid machines it is however necessary to use some device to thrust the work through the mill. Where a substantial reduction in cross section is imparted to relatively thick work the rollers apply a respectable force to the work counter to the direction of travel, primarily where it enters the working section of the mill. The working rollers are unable to apply a grip sufficient to obtain the automatic drawing of the work through the mill, and a special conveyor mechanism has to be used for this purpose. Usually the mills of the type indicated are provided with a feed roller pair in advance of the rolling mill section. The driven feed rollers apply the necessary force to feed the work through the mill. ("The Rolling of Strip, Sheet and Plate", 2nd edition, Eustace C. Larke, Chapman and Hall Ltd., London, Page 57, and "Iron and Steel Engineering," issue January 1971, and "Das Pendelwalzwerk in der Bandfertigung", DGM-Fachbericht by J. Frohling and K. Wiedemer, and "Neue Entwicklung beim Stahlstrang-Giesswalzen", Baender Bleche Rohre, No: 12, 1969, S. 707).

In handling work of finite lengths, for example individual ingots, instead of feed rollers, a mechanically or hydraulically operated ramming device, hereinafter referred to as a ram, may be used, the head of this device being applied to the rear end of the material to be rolled (ingot) to transmit the requisite effort to feed the work forward. By this means it is possible to work the ingot to a relatively small remainder, because the head of the ram can move right to the vicinity of the circular envelope or superfices of the rollers in the case of a planetary mill or the curved superfices of the deforming tools in another of the aforesaid major deformation machines to apply the feed effort to the work.

An ingot can however only be completely ruled out if it is thrust through the major deformation machine by an intermediate block interposed between the ingot and the head of the ram or by an immediately succeeding ingot.

The use of a fresh intermediate block for this purpose with every ingot is however troublesome because the intermediate block also has to be heated up to the rolling temperature. Because the block also is partly deformed by the rollers in the process of pushing the end of the ingot through it can only be used once and becomes scrap.

The use of a direct succession of a plurality of ingots is impossible for technical reasons where these are of large dimensions.

This fact is a serious drawback, particularly when further rolling units follow the major deformation machine to enable the pre-rolled strip to be further given rolling treatment in the same stream, because the end of the ingot cannot pass through the major deformation machine.

The aim of the present invention is to eliminate this shortcoming.

According to the invention a method of rolling ingots into metal strip is characterised by the fact that the ingots are each forced into a major deformation machine by means of a conveyor mechanism, that as the trailing end of the ingot nears the said machine the conveyor mechanism is stopped and the spacing between the axes of the roller systems is reduced in order to roll the part of the work in the roller contact section until separation takes place, and that the so-separated rear end section of the ingot is drawn back out of the major deformation machine.

Advantageously a ram applied to the rear end of the ingot may be used as the conveyor mechanism, and the end of the ingot may be detachably clamped to this ram so that the separated end section of the ingot can be retracted with the ram and then removed from the latter.

The invention further provides an apparatus for carrying out the method defined above, including a major deformation machine having two working roller systems, and means for varying the distance between the axes of these systems, characterised by a conveyor mechanism for forcing an ingot into the major deformation machine and a control device for determining the approach of the rear end of the ingot to the major deformation machine, stopping the conveyor mechanism and starting a mechanism for adjusting the distance between the axes of the roller systems to reduce their spacing.

The following description is concerned with the application of the invention to a planetary rolling mill. It will be understood that this method can also be applied to other forms of major deformation proccesses referred to above.

Preferred embodiments of the invention will now be described with reference to the drawings in which FIG. 1 is a diagrammatic side view of a planetary mill, without constructional details such as the bearings for the various rollers, and FIG. 2 is a side view of a floor frame for the bearings of the planetary roller systems.

The planetary mill illustrated has two planetary roller systems, each comprising a main shaft 1 with, for example, eight planetary rollers 2 each, these being held parallel to the related main shaft. The main shafts are mounted in plummer blocks 13 (FIG. 2) which are in turn mounted in a frame 14. The upper plummer blocks are rigidly connected to the frame 14 in operation whereas the lower plummer blocks are vertically displaceable. By means of a hydraulic adjusting mechanism including a piston 15 and a cylinder 16 connected to frame 14, the lower plummer blocks may be raised or lowered for varying the width of the rolling gap between the circular superfices 3 of the planetary rollers. It will be obvious that if desired all plummer blocks could be vertically displaceable and a suitable adjusting mechanism could be arranged to move the upper and lower plummer blocks to and from one another.

According to FIG. 1 an ingot, for example of preheated steel, with a rear end section designated 4 in the drawing, and of about 300 mm thickness, is rolled in the planetary mill to a strip 5 of for example about 40 mm thickness. The strip 5 runs between guide rollers 6 and driven feed rollers 7 and over guide rollers 8 to a cropping shears 9. This mechanism which may be a fly shears or swing shears allows the beginning of the strip, which has overlaps, to be cut off during passage through the mill. Likewise the end of the strip carrying overlaps can be cut from a sound strip at full rolling speed or, if necessary, the strip can be severed at any time. From the shears the strip passes to the first roll stand of a succeeding unit where it may be rolled to sheet form. Since the strip does not need to rest on rollers 8 during the operation it may form an accumulator loop to facilitate control of the rate of travel.

The operation of the drive to the mainshaft 1 and the planetary rollers 2 is so synchronised that a continual effort acting rearwards (that is to say to the left in the drawing) is constantly exerted on the work in the rolling mill. This means that the ingot must be thrust into the mill. For this purpose a ram 11 is located at the rear end of the ingot, this ram being urged in the direction of the arrow by a mechanically or hydraulically operated thrust mechanism or feed device. A driven gear wheel 17, meshing with teeth or a rack 11*a* on the ram, has been shown in FIG. 1 as an example for such a thrust mechanism. The rear end of the ingot is connected to the ram 11 by a clamp 12, preferably hydraulically operated, controlled by a special control means.

When the end of the ingot passes into the rolling mill problems arise because the head of ram 11 must not pass into the projectory of the circular envelope 3 transcribed by the planetary rollers 2, so that it is not able to push the end of the ingot through the rolling mill. On the other hand the planetary rollers cannot be guaranteed to exert the grip which will enable this end of the ingot to be pulled through.

To enable the work to be handled without interruption in the planetary mill or in the ensuing rolling path the following expedient is adopted: the forward thrust action of the ram 11 is stopped at a predetermined short distance before the latter reaches the envelopes or superfices 3. This stopping of the ram feed can for example be effected by means of a control device 18 having an electric switch 19 which is operated by a projecting part near the front end of ram 11, such as by the clamp 12. The control device 18 may be constructed so that upon operation of switch 19 the ram feed gear 17 makes one more revolution, for example, and then stops. At the same time the mechanism 15, 16 for adjusting the plummer blocks 13 of one of the mainshafts 1 is brought into action to move one of the planetary systems against the other. As a result the work which is stationary at the entrance of the mill is rolled until it breaks at the thinnest part. The rate of closure of the roller systems may be relatively high because the thickness of the work at this severance point may be reduced by about 5 to 6 mm per roller contact. Because of the acceleration forces which periodically occur in the planetary roller systems and the consequent tension stresses generated in the strip the severance of the residual piece can be expected at about a thickness of 3 to 4 mm. By using a simple expedient the closure movement of the roller systems can be limited in such a way that the danger of any contact between the planetary roller pairs can be eliminated.

Thus the severance of a strip of 35 to 45 mm thickness can be completed in the manner described above in 7 or 8 roller contacts. With the mill operating for example at 1800 roller contacts per minute, it will be seen that this operation can take place in about 0.3 seconds.

The roller stand 10 can operate at a constant speed if a strip loop is provided after the feed rollers 7 to produce a reserve of the order of magnitude of about b 1 meter which compensates during the severing operation for the restricted volume of strip until the end of the strip has left the rollers 7.

It is also possible to carry out the severing operation more slowly, for example the feed speed can be gradually reduced starting somewhere before the arrest of the ram 11. In this event the control device 18, 19 must ensure that the rate of rotation of the roller pair 7 is adapted to the thus-varying average strip speed. In this event moreover a correspondingly greater reserve of strip must be provided for between the feed rollers 7 and the four-high mill 10. This can be achieved without difficulty.

After the severing operation is completed the ram 11 and the separated end section of the ingot clamped to it are withdrawn from the planetary mill. If no clamp 12 is used the cut-off piece of ingot must be withdrawn separately from the planetary mill.

The same method of separating the strip from the end of the ingot can also be used where, instead of the ram, feed rollers are used. Shortly before the end of the ingot leaves the feed rollers, these are stopped and at the same time the closure movement between the roller systems, as described above, is initiated. After the strip has been separated from the residual piece of the ingot, this latter can be removed by reversing the direction of operation of the rollers.

The above described operations could of course be controlled manually, if desired, instead of automatically by means of the control device 18, 19.

What I claim is:

1. A method of rolling ingots into metal strip by means of a major deformation machine having two working roller systems with parallel axes, comprising the steps of forcing each ingot into said machine by means of a conveyor mechanism, stopping said conveyor mechanism as the trailing end of the ingot nears the said machine and reducing the spacing between the axes of the roller systems in order to roll the part of the work in the roller contact section of said machine until separation takes place, and drawing the so-separated rear end section of the ingot back out of the major deformation machine.

2. A method as claimed in claim 1, wherin a ram engaging the rear end of the ingot is used as the conveyor mechanism, and wherein said ram is stopped as it approaches the curved trajectories of the working rollers.

3. A method as claimed in claim 2, wherein the end of the ingot is connected to the ram, and the separated section of the ingot is withdrawn from the machine with the ram and is then removed from the ram.

4. A method as claimed in claim 1, wherein driven feed rollers are used in the conveyor mechanism, and wherein these feed rollers are stopped before the trailing end of the ingot leaves them, and are subsequently driven in the reverse direction to withdraw the cut-off end section of the ingot from the machine.

5. A method as claimed in claim 1, wherein a planetary rolling mill is used as the major deformation machine.

6. An apparatus for rolling ingots into metal strip, comprising a major deformation machine having two working roller systems with parallel axes, an adjusting mechanism for varying the distance between the axes of said working roller systems, a conveyor mechanism for forcing an ingot into said major deformation machine, and a control device for determining the approach of the rear end of the ingot to said major deformation machine, stopping said conveyor mechanism and starting said adjusting mechanism to reduce the distance between the axes of said roller systems until the part of the work in the roller contact section of said major deformation machine becomes separated.

7. Apparatus as claimed in claim 6, wherein said conveyor mechanism comprises a ram adapted to force an ingot into said major deformation machine and a feed device for moving said ram, and wherein said control device is operable in response to the approach of said ram to the trajectories of the working rollers.

* * * * *